US007882591B2

(12) United States Patent
Arnold

(10) Patent No.: US 7,882,591 B2
(45) Date of Patent: Feb. 8, 2011

(54) PREWASH DISH CLEANING DEVICE

(76) Inventor: Mark T. Arnold, P.O. Box 525, Clinton, WA (US) 98236

( * ) Notice: Subject to any disclaimer, the term of this patent is extended or adjusted under 35 U.S.C. 154(b) by 668 days.

(21) Appl. No.: 11/998,796

(22) Filed: Nov. 30, 2007

(65) Prior Publication Data

US 2009/0064445 A1 Mar. 12, 2009

Related U.S. Application Data

(63) Continuation of application No. PCT/US2006/021826, filed on Jun. 5, 2006.

(60) Provisional application No. 60/687,509, filed on Jun. 3, 2005.

(51) Int. Cl.
*B08B 5/00* (2006.01)

(52) U.S. Cl. ..... 15/301; 15/302; 15/303; 15/306.1; 15/345.346

(58) Field of Classification Search ..... 15/301, 15/302, 303, 306.1, 309.1, 345, 346; *B08B 5/00, B08B 5/02, 5/04*
See application file for complete search history.

(56) References Cited

U.S. PATENT DOCUMENTS

| | | | |
|---|---|---|---|
| 4,198,725 | A | 4/1980 | Trutzschler |
| 4,437,479 | A | 3/1984 | Bardina et al. |
| 4,949,424 | A | 8/1990 | Shero |
| 4,961,244 | A | 10/1990 | Stanfield et al. |
| 4,974,618 | A | 12/1990 | Nysted |
| 5,206,970 | A | 5/1993 | Johnson |
| 5,305,493 | A | 4/1994 | Prenn |
| 5,419,349 | A | 5/1995 | Swain |
| 5,584,094 | A | 12/1996 | Gurstein |
| 5,661,872 | A | 9/1997 | Meyer et al. |
| 6,216,314 | B1 | 4/2001 | Dangerfield |
| 6,295,696 | B1 | 10/2001 | Harmon |
| 6,434,783 | B1 | 8/2002 | Arnold et al. |
| 6,521,051 | B1 | 2/2003 | Lutich |
| 7,051,400 | B1 | 5/2006 | Saldivar |
| 7,293,323 | B1 | 11/2007 | Hoce |
| 2005/0183231 | A1 | 8/2005 | Mein |

FOREIGN PATENT DOCUMENTS

| | | |
|---|---|---|
| DE | 19532576 A | 3/1997 |
| EP | 41646 | 5/1981 |
| EP | 0813230 A | 12/1997 |

*Primary Examiner*—David A Redding
(74) *Attorney, Agent, or Firm*—FSP LLC

(57) ABSTRACT

A pre-wash device for dishes and/or utensils includes a vacuum chamber comprising a collection vessel open to the vacuum chamber, a food material collection pan exhausting into the vacuum chamber at a location where material from the collection pan falls into the collection vessel at an end of the collection vessel open to the vacuum chamber, and a blower having an intake in the vacuum chamber and an exhaust directed and focused to force food material on plates and/or utensils into the collection pan.

6 Claims, 3 Drawing Sheets

PREWASH DISH CLEANING DEVICE

PRIORITY CLAIM AND CROSS REFERENCE TO RELATED APPLICATIONS

This application claims priority under 35 U.S.C. 120 and/or 35 U.S.C. 365 as a continuation of PCT application PREWASH DISH CLEANING DEVICE, having application number PCT/US06/21826, filed on Monday, Jun. 5, 2006, which claims the benefit of U.S. provisional application 60/687,509.

TECHNICAL FIELD

The present disclosure relates to dish and utensil cleaning.

BACKGROUND ART

Residential and commercial waste water streams are commonly treated by either on-site (e.g., septic systems) or municipal waste water systems. In both instances, the waste water is subjected to some form of aerobic and/or anaerobic biological treatment, in order to render the constituents of the waste stream safe prior to being discharged into the environment.

The efficacy of the biological treatment processes utilized in these systems are quite sensitive to levels of certain constituents in the waste stream. In particular, with respect to the present invention, significant components of the waste stream include the following:

(1) Fats, Oils and Grease (referred to herein as "F.O.G.");

(2) Biochemical Oxygen Demand (referred to herein as "B.O.D."), which is directly related to the levels of undigested food present in the waste stream;

(3) Total Suspended Solids (referred to herein as "T.S.S."), which includes levels of both food and human waste; and (4) Fecal Bacteria Count (referred to herein as "FECAL").

While most residential waste water streams have F.O.G., B.O.D., T.S.S., and FECAL levels which are within acceptable limits, restaurants and other commercial/institutional food service operations (referred to collectively herein as "food service establishments") often produce waste water streams which far exceed acceptable limits in one or more of these categories.

In particular, food service establishments tend to introduce very high levels of grease and undigested food into the waste water stream via the kitchen sink, into which these materials are flushed from pots, pans, dishes and utensils prior to being washed. For example, in a typical food service establishment, the first step in the dishwashing process is to quickly scrape the largest pieces of uneaten food into a trash can, and then rinse the plates/utensils off using a spray nozzle before placing them in the wash sink or in a mechanical dishwasher. The intended purpose of the initial scraping step is to reduce the amount of large-sized food solids which are flushed down the drain (mostly in an effort to prevent clogging), but in fact manual scraping is grossly inefficient and leaves very large amounts of food/grease on the cookware/servingware and utensils, thus necessitating the preliminary rinse step. Moreover, food service establishment dishwasher personnel are often poorly paid and constantly harried to work faster, with the result that the initial scraping is often cursory at best.

As a result, food service establishment waste water streams are commonly characterized by F.O.G., B.O.D., and T.S.S. levels which far exceed acceptable limits. For example, many food service establishments having on-site waste water treatment systems (usually, a septic tank and drain field) are required by regulation to maintain waste water streams within parameters such as the following:

F.O.G. 40 ppm B.O.D 230 ppm T.S.S. 145 ppm

In fact, because of the problems noted above, the following waste water test results are more typical for a commercial restaurant operation:

F.O.G. 3,000 ppm B.O.D. 21,000 ppm T.S.S. 3,900 ppm

As can be seen, these levels exceed acceptable parameters by up to 100 times, which means that not only is such a restaurant operating well out of regulatory limits for an on-site treatment system, but in fact the drain field and other components of such a system will be rendered inoperable in a comparatively short time, necessitating extremely expensive repairs. This problem is aggravated by the large amount of water which is used to rinse the plates/utensils, which not only increases the water bills for the facility, but can also lead to excessive hydraulic loading of the septic system.

Municipal waste water treatment systems (i.e., sewer systems) also typically require food service establishments to maintain F.O.G., B.O.D., and T.S.S., levels within certain, comparable limits, since high levels of these components will similarly impair the operation of municipal sewage plants and impact their ability to discharge effluent which is within environmentally acceptable limits. As a result, the waste water streams of food service establishments are routinely tested by municipalities to ensure that they are within specified limits, and if the limits are exceeded the establishment may be subjected to fines and/or surcharges to compensate the municipality for the additional costs involved in treating the material.

For these reasons, many restaurant and other food service establishment operators have had to install complicated and expensive systems in an effort to remove food and grease from their waste water streams. For example, many restaurants and other food service establishments have installed very costly waste water grease collection and trap systems. Under ideal operating conditions, many of these systems are capable of removing up to 98% of the grease from the waste water. Unfortunately, proper operation of these systems is, as a rule, highly sensitive to the levels of food and particulate material in the waste stream; in other words, the grease extractor systems are capable of effectively removing grease/oil from the waste water streams, but only if virtually all of the food is scraped off of the plates/utensils before they are rinsed or washed. For the reasons discussed above, however, it is the rare exception that the plates/utensils are scraped completely clean before they are introduced into the water stream, with the result that grease extractors systems installed at food service establishments almost invariably require high levels of maintenance, and are often clogged or otherwise rendered inoperative by high food levels in the waste water. Moreover, even when grease extractor systems are functioning properly, they are very expensive to service and maintain, since special facilities are required for disposal of the collected material and servicing cannot be performed by conventional septic tank pumping companies.

In some extreme instances, restaurants and other food service establishments using on-site waste water treatment systems have been forced to construct much larger treatment systems in order to handle the high F.O.G., B.O.D., and T.S.S. loads produced by their operations. Because of the space limitations common in restaurants and other commercial operations, many of these enlarged waste water systems must be located "off-site" at a remote locations which are capable of accommodating the much larger drain fields. This involves extreme expense, in purchasing the additional real estate, laying piping to the remote site, and installing the additional drain field. Such costs are simply beyond the reach of many food service establishments, especially independent restaurant operations, which are then faced with the prospect of having to close down the business.

Accordingly, there exists a need for an apparatus which can be used to reduce F.O.G., B.O.D., and T.S.S. levels in food service establishment waste water streams to within acceptable levels. Furthermore, there exists a need for such an apparatus which will reduce or eliminate the necessity for any pre-wash rising of plates and utensils, so as to reduce the total amount of water which is used in the washing process. In addition, there exists a need for such an apparatus which is sufficiently effective and convenient to use that it will be employed effectively by food service establishment kitchen personnel. Still further, there exists a need for such an apparatus which is sufficiently inexpensive to be economically available to the majority of food service establishment operations, and which is also reliable and inexpensive to maintain. Still further, there exists a need for such an apparatus which is safe and sufficiently quiet for use in a kitchen facility, which is commonly located adjacent the dining area of the food service establishment.

U.S. Pat. No. 6,434,783 describes such an apparatus. However, the apparatus described therein has certain limitations, including excessive vacuum turbulence in the collection vessel.

DISCLOSURE OF INVENTION

The following summary is intended to highlight and introduce some aspects of the disclosed embodiments, but not to limit the scope of the claims. Thereafter, a detailed description of illustrated embodiments is presented, which will permit one skilled in the relevant art to make and use various embodiments.

A pre-wash device for dishes and/or utensils may include and/or involve a vacuum chamber including a collection vessel open to the vacuum chamber, a food material collection pan exhausting into the vacuum chamber at a location where material from the collection pan falls into the collection vessel at an end of the collection vessel open to the vacuum chamber, and a blower having an intake in the vacuum chamber and an exhaust directed and focused to force food material on plates and/or utensils into the collection pan.

The exhaust may be focused through slits to create sheets of pressurized air directed at the plates and/or utensils, and in particular through v-shaped slits positioned over a conveyor. The exhaust may be focused through slits in pivotable air channels that may be rotated longitudinally to adjust the vertical angle of the sheets of pressurized air with respect to the dishes and/or utensils.

The pre-wash device for dishes and/or utensils may include and/or involve a conveyor, and stops along the conveyor for the application to dishes and/or utensils of soap and the subsequent application to the dishes and/or utensils of pressurized air from the blower.

Other system/method/apparatus aspects are described in the text (e.g., detailed description and claims) and drawings forming the present application.

BRIEF DESCRIPTION OF THE DRAWINGS

In the drawings, the same reference numbers and acronyms identify elements or acts with the same or similar functionality for ease of understanding and convenience. To easily identify the discussion of any particular element or act, the most significant digit or digits in a reference number refer to the figure number in which that element is first introduced.

INDUSTRIAL APPLICABILITY AND MODES FOR CARRYING OUT THE INVENTION

References to "one embodiment" or "an embodiment" do not necessarily refer to the same embodiment, although they may.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
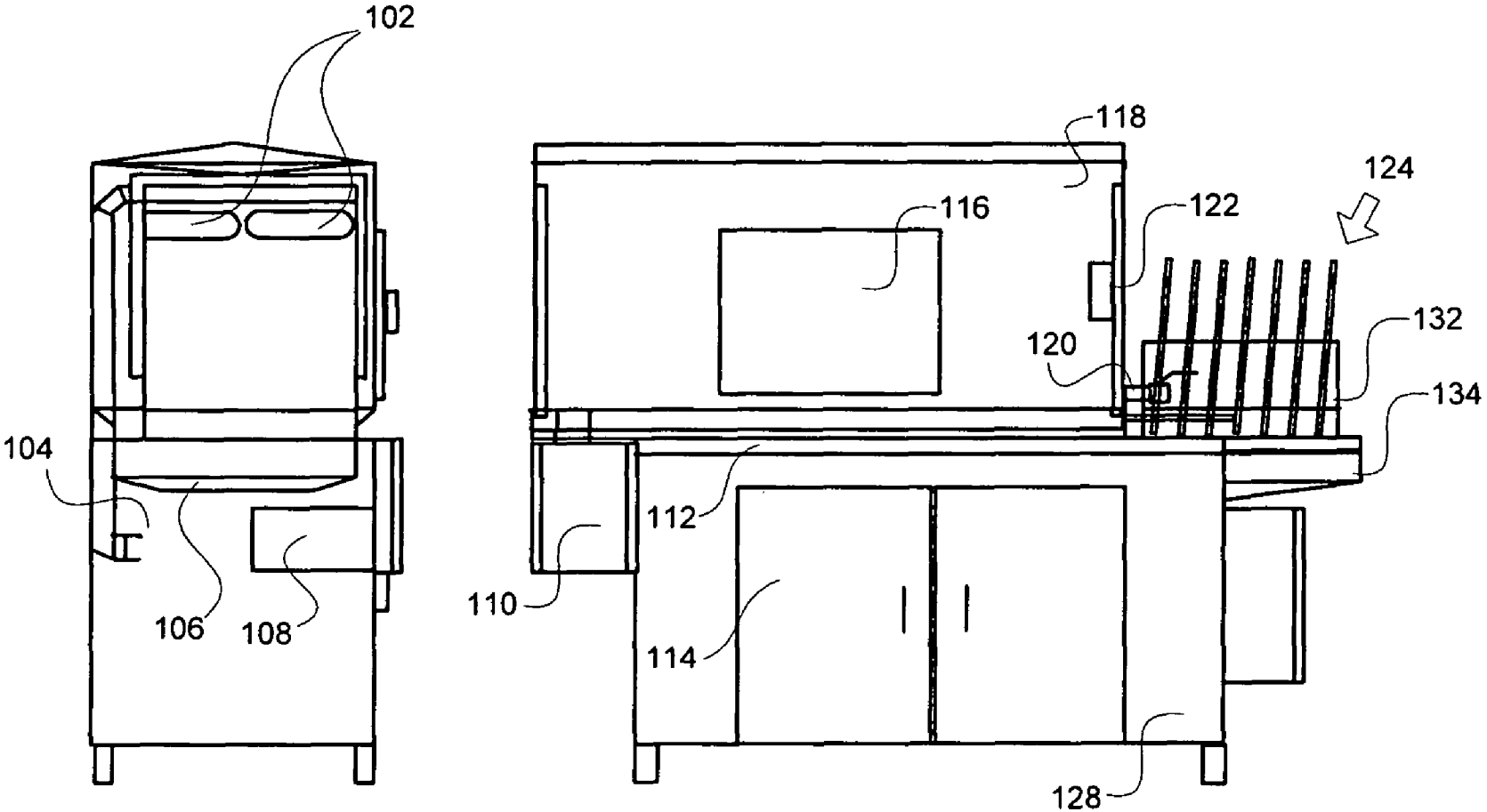
FIG. 1 is an illustration of an embodiment of an automatic vacuum pre-wash unit for dishes and utensils.

FIG. 1 is an illustration of an embodiment of an automatic vacuum pre-wash unit for dishes and utensils. The unit includes a cabinet 128 with doors 114. Inside the area enclosed by the doors 114 but not shown in FIG. 1 are parts of the unit such as blower, food collection vessel, and soap reservoir and soap pump.

A conveyer belt motor housing 110, conveyer belt housing 134, and rack guide 112 are co-located with the cabinet 128. The unit comprises a cleaning chamber 118 and operational indicators 122. The indicator area 122 may also comprise controls for initiating pre-clean functions (e.g. ON, OFF). Status indicators may include "ready to begin", "soaping in progress", "pre-cleaning in progress", "pre-cleaning complete", and "abnormal termination", for example. In some embodiments indicators 122 may comprise LEDs or a small display. Activity occurring within the chamber area 118 may be visually assessed and the chamber area 118 accessed using a window and/or door 116 which may be provided in some embodiments.

The chamber area 118 may also be accessible from either side. A dish rack 132 holding dishes and/or utensils 124 may be placed on the side where, when the conveyer belt is operated, it may be drawn into the cleaning chamber 118. When the unit detects that the rack 132 has reached a certain position (for example, by activating a limit switch), it may initiate the spraying of soap over the dish rack 132 and dishes and utensils 124 sitting therein.

This operation may be followed by a pause during which time the soap may act to loosen attached food matter. The conveyer belt may then continue to move the dish rack 132 conveying dishes and utensils 124 to a position under the air knife generators 102. The air knife generators 102 comprise slits creating sharp sheets of pressurize descending air which may push the food matter off of the dishes and utensils 124. The descending air may be created by action of a blower (not shown in this figure). Food material removed by the air streams may be further pulled by gravity and suction (for example also created by a blower) into a collection pan 106. From the collection pan 106 the food material may fall and be drawn into a collection vessel (not shown on this drawing). When the dish rack 132 has been completely drawn under the air knife generators 102 the conveyer belt may stop. At this point a status indicator may provide visual and/or sound status indicating that the pre-cleaning operation is complete. An operator may remove the dish rack 132 from the unit. In some situations, the dish rack 132 may then be placed in a dishwasher. Hot water may then be admitted via a valve 120 to clean the cleaning chamber 118, conveyor belt, collection pan 106, and so on.

A side view (left side of illustration) into the unit provided in FIG. 1 shows the air knife generators 102, the blower exhaust hose 104, the collection pan 106, and the conveyer belt motor 108.

Figure 2:
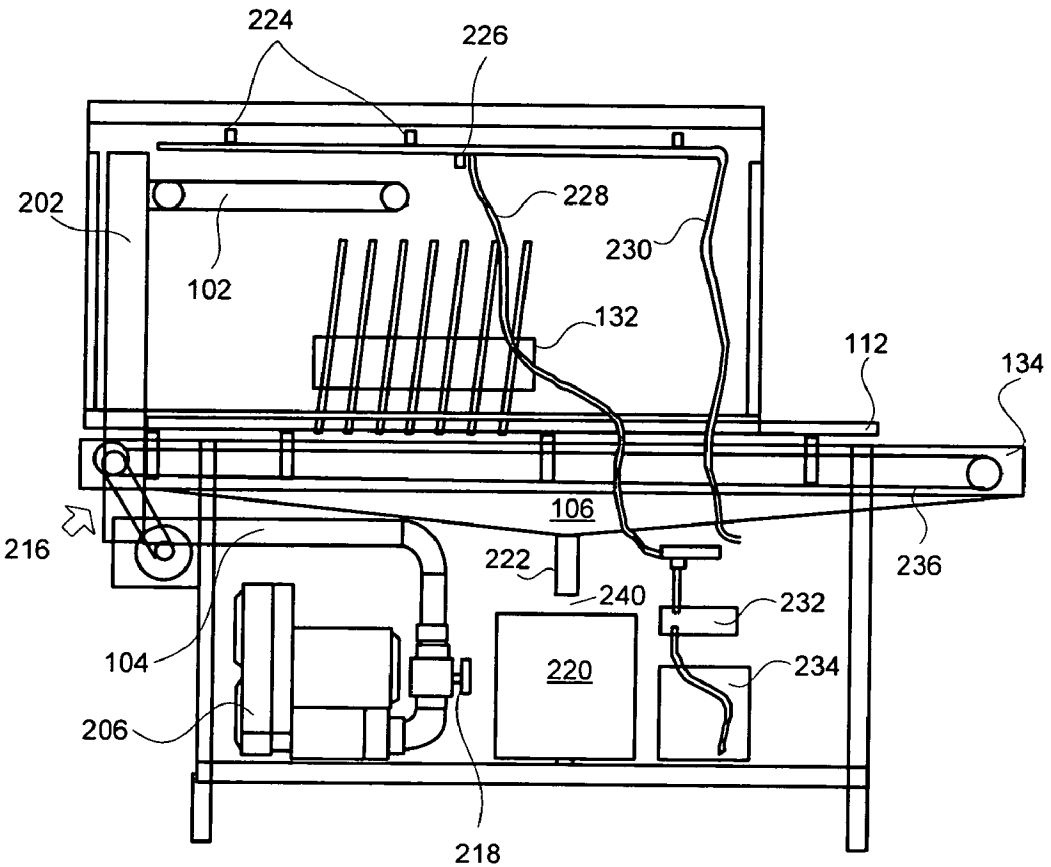
FIG. 2 is an illustration of an embodiment of an automatic vacuum pre-wash device for dishes and utensils, comprising front and side views into the unit.
Figure 2:
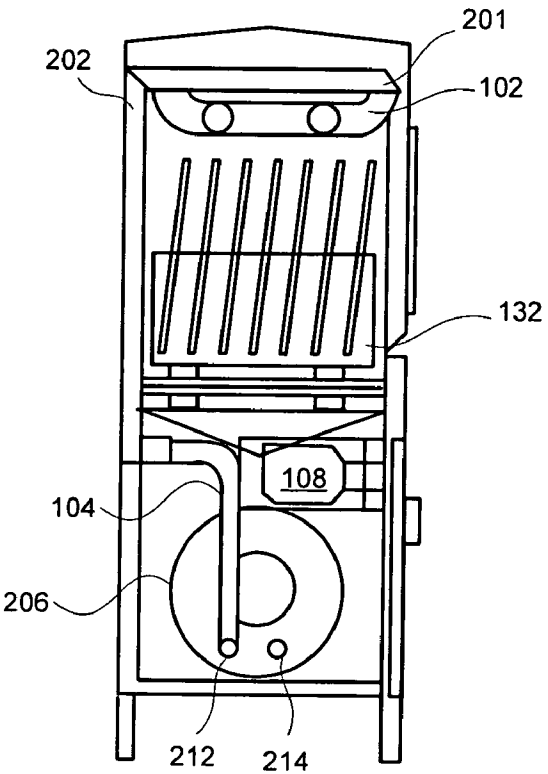

FIG. 2 is an illustration of an embodiment of an automatic vacuum pre-wash device for dishes and utensils, comprising front and side views into the unit.

The unit may comprise the air knife generators 102, a blower exhaust outlet hose 104, a collection pan 106, and a conveyer belt motor 108. The unit may also comprise the blower intake 214, the blower 206, and the opening 212 where the air from the blower exhaust enters the blower exhaust outlet hose 104. The blower outlet exhaust outlet hose 104 may be attached to an air channel 202 in the cabinet 128/cleaning area 118. The air channel 202 may be attached to a manifold 201. The manifold 201 is attached to the air knife generators 102. Thus air exhausted by the blower 206 travels through the hose 104, air channel 202, through the manifold 201, and through the air knife generators 102 to wind up as "air knives", which are sheets of pressurized air. Each air knife generator 102 comprises a slit which shapes the moving air into a sheet. The slits are positions so that the air knives travel over the dishes and utensils in the dish rack 132. The quickly moving air knocks the food matter off of the dishes and utensils and it falls and is sucked into the collection pan 106.

A pipe, tube, or hose 222 is provided at the bottom of the collection pan 106. The dropping food matter falls through the pipe or hose 222 into the food collection vessel 220. There may be an air gap (e.g. space) 240 located between the bottom of the pipe or hose 222 and the food collection vessel 220, or the pipe 222 may extend into the top end of the collection vessel 220.

When the blower 206 is operating, air may travel from the utility chamber in which the blower 206, etc. is located into the air intake 214, which is located within the chamber. This may create a depressurization of the utility chamber. As a result, the air flow (which includes food material) going through the pipe or hose 222 from the collection pan 106 may be "pulled" by the vacuum effect as it enters the utility chamber. Food matter drops and is pulled from the pipe or hose 222 into the collection vessel 220.

A blower exhaust shutoff 218 may be present in some embodiments. The utility chamber may also contain a soap reservoir 234 and soap pump 232. A soap pump line 228 may carry soap to a soap nozzle 226 present within the cleaning chamber 118. There may also be water spray nozzles 224 within the cleaning chamber. The soap nozzle 226 and/or water spray nozzle 224 may be located above and/or to the side of the area into which the dish rack 132 and dishes may be pulled.

Power to the blower 206 and/or soap pump 232 may be associated with an automatic shutoff timer, so that the blower 206 and/or soap pump 232 automatically shuts off after a period of operation.

The conveyer belt drive assembly 216 drives the conveyer belt 236. The conveyer belt is housed in a conveyer belt housing 134. The dish rack 132 with dishes may be pulled toward and past the soap nozzle 226 and may be sprayed with soap as they move. The spraying of soap may be triggered by the dish rack 132 touching or moving to or past a preset position within the cleaning chamber 118. The spraying of soap may end when the dish rack 132 touches or moves to or past a second pre-set position. A pause may occur after the spraying of soap has ended, with the conveyer belt 236 not moving during this pause. The pause may enable the soap to loosen food particles which may be present on the dishes.

After the dish rack 132 moves to the second pre-set position (and in some embodiments after the pause) the conveyer belt 236 may move it further so that it comes into an area of the cleaning chamber where the air knife generators 102 may direct sheets of air "air knives" over the dishes and utensils. The blower 206 may be operating during this period. The food material dislodged by the air knives may fall into the collection pan 106 and wind up in the collection vessel 220 as previously discussed.

Thus, a pre-wash device for dishes and/or utensils may include and/or involve a vacuum chamber including a collection vessel open to the vacuum chamber, a food material collection pan exhausting into the vacuum chamber at a location where material from the collection pan falls into the collection vessel at an end of the collection vessel open to the vacuum chamber, and a blower having an intake in the vacuum chamber and an exhaust directed and focused to force food material on plates and/or utensils into the collection pan.

The exhaust may be focused through slits to create sheets of pressurized air directed at the plates and/or utensils, and in particular through v-shaped slits positioned over a conveyor. The exhaust may be focused through slits in pivotable air channels that may be rotated longitudinally to adjust the vertical angle of the sheets of pressurized air with respect to the dishes and/or utensils.

The pre-wash device for dishes and/or utensils may include and/or involve a conveyor, and stops along the conveyor for the application to dishes and/or utensils of soap and the subsequent application to the dishes and/or utensils of pressurized air from the blower.

The water spray nozzles 224 may not usually operate during dish and utensil cleaning. However, the water spray nozzles 224 may provide water which may be used, possibly in addition with the soap nozzle 226, to clean the cleaning chamber itself. Water pressure applied to intake nozzle 120 may propagate up water hose 230 to the water spray nozzles 224, drenching the cleaning chamber 118 and facilitating wash-down.

Figure 3:
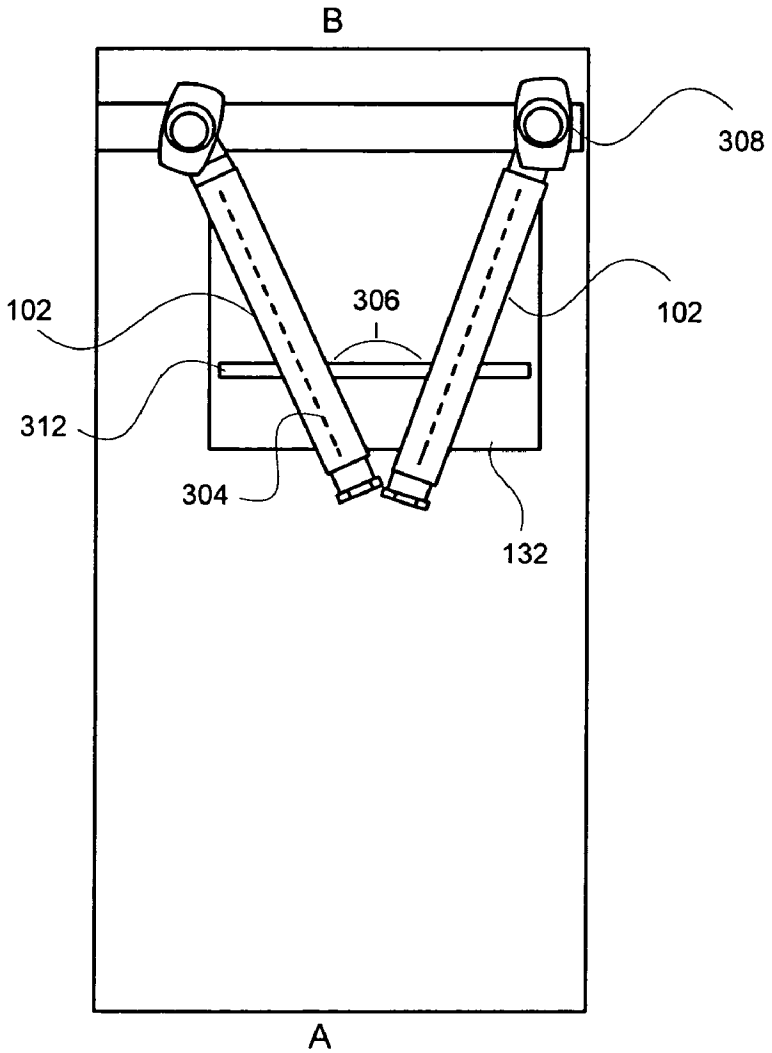
FIG. 3 is a top-view illustration of an embodiment of the cleaning chamber of an automatic vacuum pre-wash unit for dishes and utensils.

FIG. 3 is a top-view illustration of an embodiment of the cleaning chamber 118 of an automatic vacuum pre-wash unit for dishes and utensils. The cleaning chamber has a side A and a side B. As pre-washing occurs, the dish rack 132 travels from side A to side B.

The cleaning chamber 118 may comprise two or more air knife generators 102. Each air knife generator may have one or more air slits 304. When the unit blower 206 is operated, air travels through the air knife generators 102 and is exhausted through the air slits 304. Each air slit 304 creates a sheet of moving air, the "air knife". The air knife generators 102 are attached through a pivot 308, such that the air knife generators 102 may be pivoted in the horizontal plane of the unit. Such movement using the pivot 308 changes the angle 306 of the air knife generators 102 with respect to one other. The positioning of an air knife—the moving sheet of air—in the vertical plane is thus changed with respect to the dish rack 132 and dishes/utensils. In some implementations, the air knife generator 102 may be moved by an action of a person, but once an appropriate angle is selected the air knife generator 102 may stay at that angle until a person again physically moves it, i.e., the angle of the air knife generator 102 may not change as a part of the pre-clean operation. In other implementations, the angle 306 of the air knife generators 102 may be varied automatically or manually during the cleaning operations.

The air knife generators 102 may be rotated along their longitudinal axis as well. Rotation of the air knife generators 102 may be performed manually or automatically during cleaning, or may be preset into fixed positions.

As previously mentioned, the dish rack 132 travels from side A to side B. The air knives created by the blower operation consists of sheets of downward traveling air. As a dish 312 in the dish rack 132 first encounters the leading edge of the air knives, it encounters two (or more) sheets of air closely spaced together. Thus, a vertical portion comprising the middle of the dish 312 is touched by the air knives. As the dish 312 moves on, it continues to encounter the air knives. At that point, the air sheets are further apart. Thus, two surfaces of dish 312 are touched by the air knives. Eventually, the dish 312 will have moved (along with the dish rack 132) such that the air knives will be touching its outermost portions. So as the dish 312 moves from the leading air surface of the air knives to the trailing air surface, the food particles present on the dish 312 are dislodged first from its center and then toward its edges, swept downwards and outwards.

What is claimed is:

1. A pre-wash device for dishes and/or utensils comprising:

a vacuum chamber comprising a collection vessel open to the vacuum chamber;

a food material collection pan exhausting into the vacuum chamber at a location where material from the collection pan falls into the collection vessel at an end of the collection vessel open to the vacuum chamber; and a blower having an intake in the vacuum chamber and an exhaust directed and focused to force food material on plates and/or utensils into the collection pan.

2. The pre-wash device for dishes and/or utensils of claim 1, wherein the exhaust directed and focused to force food material on plates and/or utensils into the collection pan further comprises:

the exhaust focused through slits to create sheets of pressurized air directed at the plates and/or utensils.

3. The pre-wash device for dishes and/or utensils of claim 2, wherein the exhaust focused through slits to create sheets of pressurized air directed at the plates and/or utensils further comprises:

the exhaust focused through slits in pivotable air channels.

4. The pre-wash device for dishes and/or utensils of claim 3, wherein the exhaust focused through slits in pivotable air channels further comprises:

the exhaust focused through slits in pivotable cylindrical air channels that may be rotated longitudinally to adjust the vertical angle of the sheets of pressurized air with respect to the dishes and/or utensils.

5. The pre-wash device for dishes and/or utensils of claim 1, wherein the exhaust directed and focused to force food material on plates and/or utensils into the collection pan further comprises:

the exhaust directed and focused through v-shaped slits positioned over a conveyor.

6. The pre-wash device for dishes and/or utensils of claim 1, further comprising:

a conveyor, and stops along the conveyor for the application to dishes and/or utensils of soap and the subsequent application to the dishes and/or utensils of pressurized air from the blower.

* * * * *